US011502439B2

(12) United States Patent
Wang et al.

(10) Patent No.: US 11,502,439 B2
(45) Date of Patent: Nov. 15, 2022

(54) CONDUCTIVE TERMINAL AND MATING ASSEMBLY INCLUDING THE CONDUCTIVE TERMINAL

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Rui-Qin Wang, Kunshan (CN); Yen-Chih Chang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/200,876

(22) Filed: Mar. 14, 2021

(65) Prior Publication Data

US 2021/0296808 A1 Sep. 23, 2021

(30) Foreign Application Priority Data

Mar. 17, 2020 (CN) ..... 202010185074.2

(51) Int. Cl.

| | |
|---|---|
| ***H01R 13/20*** | (2006.01) |
| ***H01R 4/28*** | (2006.01) |
| ***H01R 43/16*** | (2006.01) |
| *H01R 13/6474* | (2011.01) |

(52) U.S. Cl.

CPC ..... *H01R 13/20* (2013.01); *H01R 4/28* (2013.01); *H01R 43/16* (2013.01); *H01R 13/6474* (2013.01)

(58) Field of Classification Search

CPC ..... H01R 13/20; H01R 13/04; H01R 13/17; H01R 13/26; H01R 4/28; H01R 43/16

See application file for complete search history.

(56) References Cited

U.S. PATENT DOCUMENTS

| | | | | |
|---|---|---|---|---|
| 4,747,794 A * | 5/1988 | Seidler | ..... | H01R 13/193 439/295 |
| 8,079,863 B2 * | 12/2011 | Wason | ..... | H01R 11/12 439/877 |
| 8,512,081 B2 | 8/2013 | Stokoe | | |

(Continued)

FOREIGN PATENT DOCUMENTS

CN 104167620 8/2017

*Primary Examiner* — Vanessa Girardi

(74) *Attorney, Agent, or Firm* — Ming Chieh Chang

(57) ABSTRACT

A conductive terminal to be mated with a mating terminal includes: a base; and a mating end at a front of the base for mating with the mating terminal, the mating end including a first mating portion for contacting with the mating terminal and a second mating portion arranged in front of the first mating portion for contacting with the mating terminal, wherein the first mating portion includes a first protrusion, the second mating portion includes a second protrusion, the first protrusion and the second protrusion protrude toward same side of the conductive terminal, the contacting direction and manner between the first protrusion and the mating terminal are different from the contacting direction and manner between the second protrusion and the mating terminal.

8 Claims, 8 Drawing Sheets

(56) References Cited

U.S. PATENT DOCUMENTS

| | | | | |
|---|---|---|---|---|
| 9,033,750 | B2 * | 5/2015 | Miller | H01R 13/26 439/862 |
| 9,077,094 | B2 | 7/2015 | Minich | |
| 9,257,778 | B2 | 2/2016 | Buck et al. | |
| 9,780,493 | B2 | 10/2017 | Cohen et al. | |
| 9,825,393 | B1 | 11/2017 | Vino, IV et al. | |
| 9,831,588 | B2 * | 11/2017 | Cohen | H01R 13/6471 |
| 10,326,244 | B2 | 6/2019 | Trout et al. | |

* cited by examiner

CONDUCTIVE TERMINAL AND MATING ASSEMBLY INCLUDING THE CONDUCTIVE TERMINAL

BACKGROUND OF THE INVENTION

1. Field of the Invention

The present invention relates generally to a conductive terminal and a mating assembly with the conductive terminal, and more particularly to a conductive terminal and a mating assembly with multiple contact point.

2. Description of Related Arts

China patent No. 104167620 discloses a mating assembly, which includes a conductive terminal and a flat mating terminal mated with the conductive terminal, the conductive terminal includes a first contact portion and a second contact portion, the first contact portion and the second contact portion elastically contact and mate the mating terminal along the same direction. When the conductive terminal and the mating terminal are inserted into each other, it is difficult to ensure that the first contact portion and the second contact portion of the conductive terminal are in conductive contact with the mating terminal, this seriously affects the integrity of the signal transmission.

An improved conductive terminal and a mating assembly is desired.

SUMMARY OF THE INVENTION

A main object of the present invention is to provide a conductive terminal and a mating assembly with the conductive terminal, the conductive terminal can be matched with the mating terminal to achieve a reliable fit for multi-point contact.

To achieve the above-mentioned object, a conductive terminal to be mated with a mating terminal comprises: a base; and a mating end at a front of the base for mating with the mating terminal, the mating end including a first mating portion for contacting with the mating terminal and a second mating portion arranged in front of the first mating portion for contacting with the mating terminal, wherein the first mating portion includes a first protrusion, the second mating portion includes a second protrusion, the first protrusion and the second protrusion protrude toward same side of the conductive terminal, the contacting direction and manner between the first protrusion and the mating terminal are different from the contacting direction and manner between the second protrusion and the mating terminal.

To achieve the above-mentioned object, a mating assembly comprises a mating terminal and a conductive terminal mated with the mating terminal, the conductive terminal comprising a base and a mating end at a front of the base for mating with the mating terminal, the mating end including: a first mating portion contacted with the mating terminal and a second mating portion arranged in front of the first mating portion and contacted with the mating terminal, wherein the first mating portion includes a first protrusion, the second mating portion includes a second protrusion, the first protrusion and the second protrusion protrude toward same side of the conductive terminal, and the contacting direction and manner between the first protrusion and the mating terminal are different from the contacting direction and manner between the second protrusion and the mating terminal.

Compared to the prior art, the first protrusion and the second protrusion protrude toward the same side of the terminal, the contacting direction and the contacting manner of the first protrusion and the mating terminal are different from the contacting direction and contacting manner of the second protrusion and the mating terminal, so that the conductive terminal can be matched with the mating terminal to achieve a reliable fit for multi-point contact.

DETAILED DESCRIPTION OF THE PREFERRED EMBODIMENT

Figure 1:
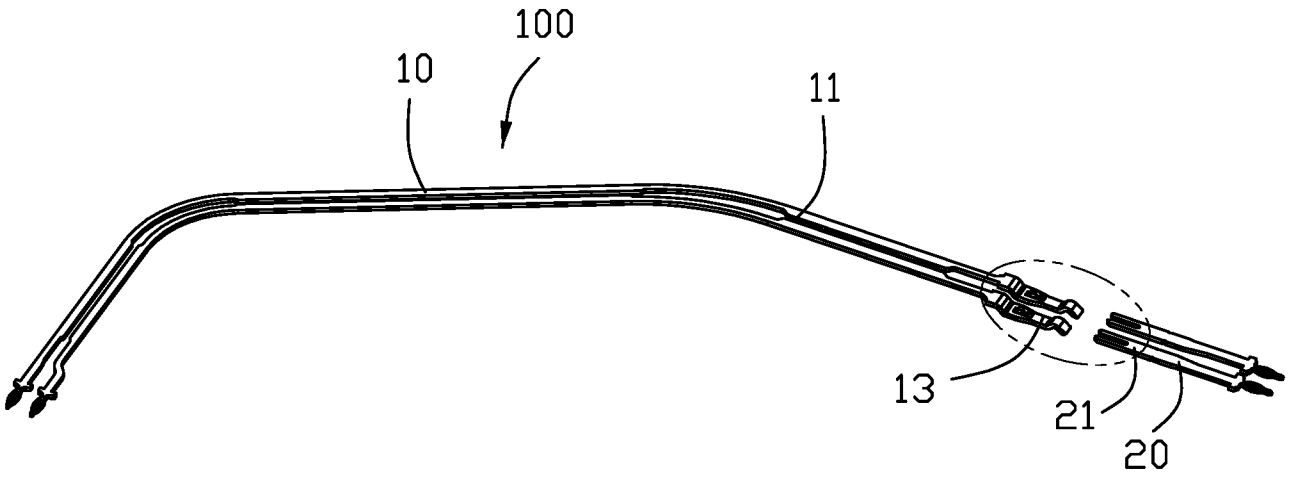
FIG. 1 is a perspective view of the first embodiment of a mating assembly of in accordance with the present invention in an unmated state.
Figure 2:
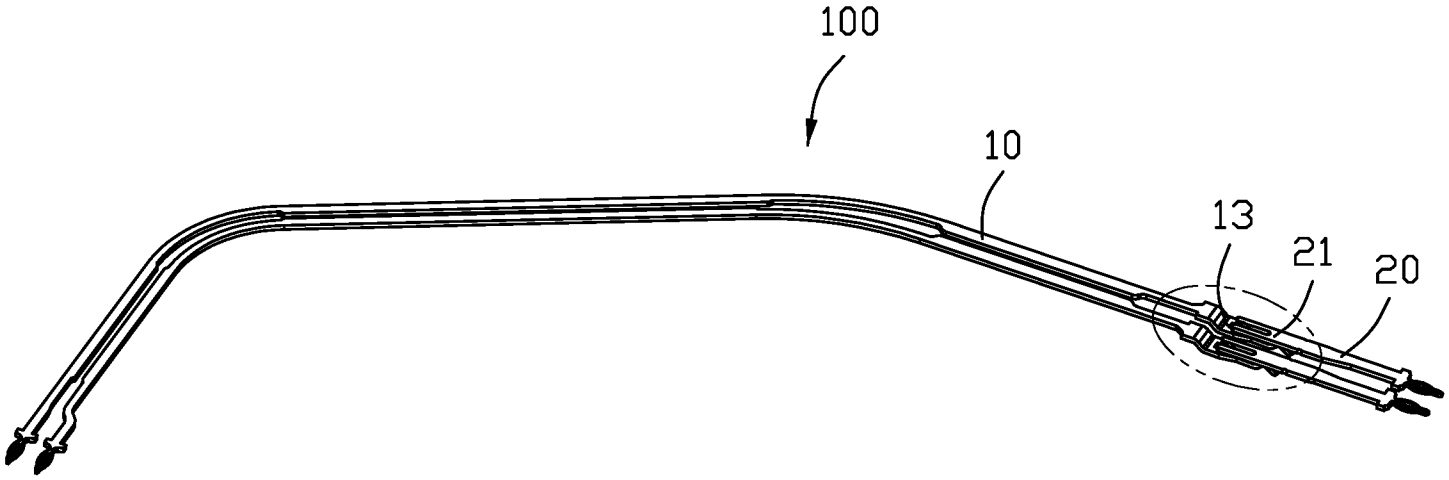
FIG. 2 is a perspective view the mating assembly in a mated state in FIG. 1.
Figure 3:
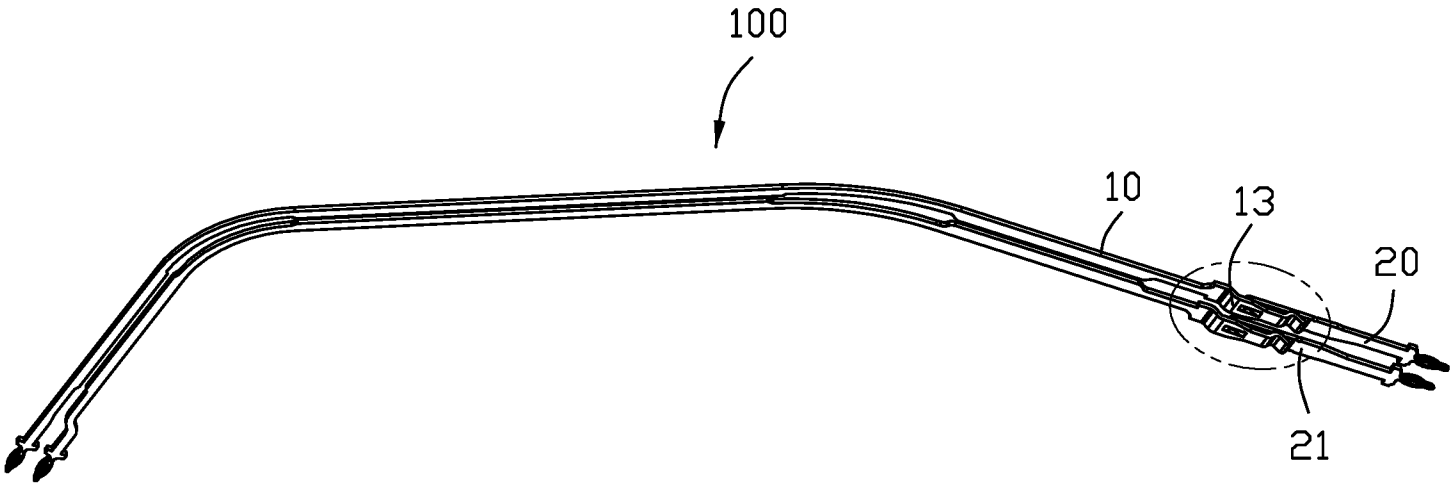
FIG. 3 is another perspective view of the mating assembly in FIG. 2.
Figure 4:
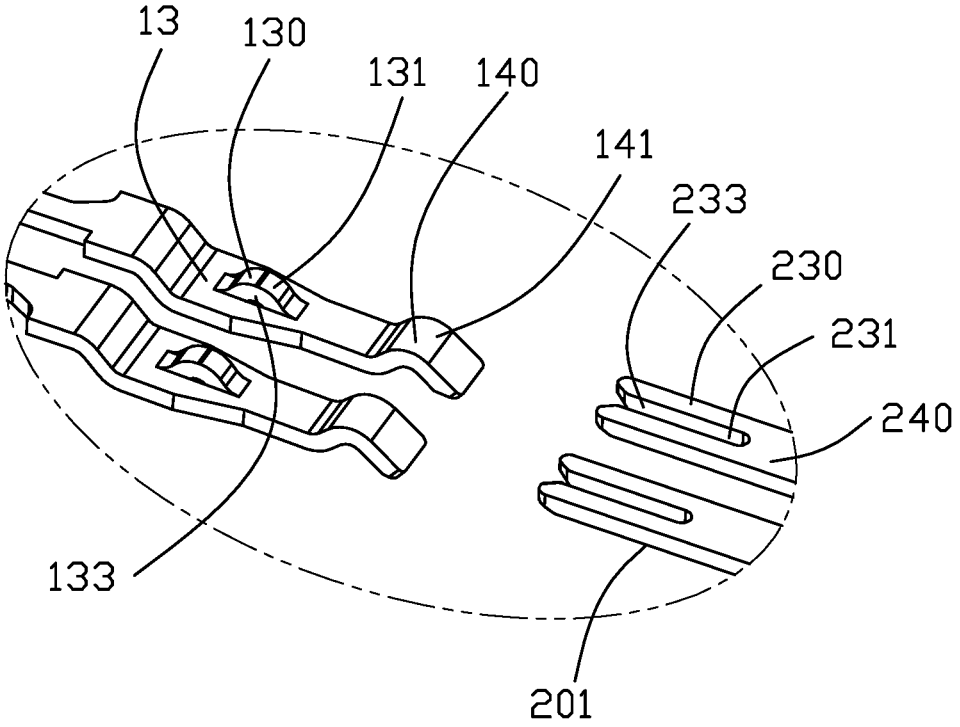
FIG. 4 is an enlarged view of the mating assembly in FIG. 1.
Figure 5:
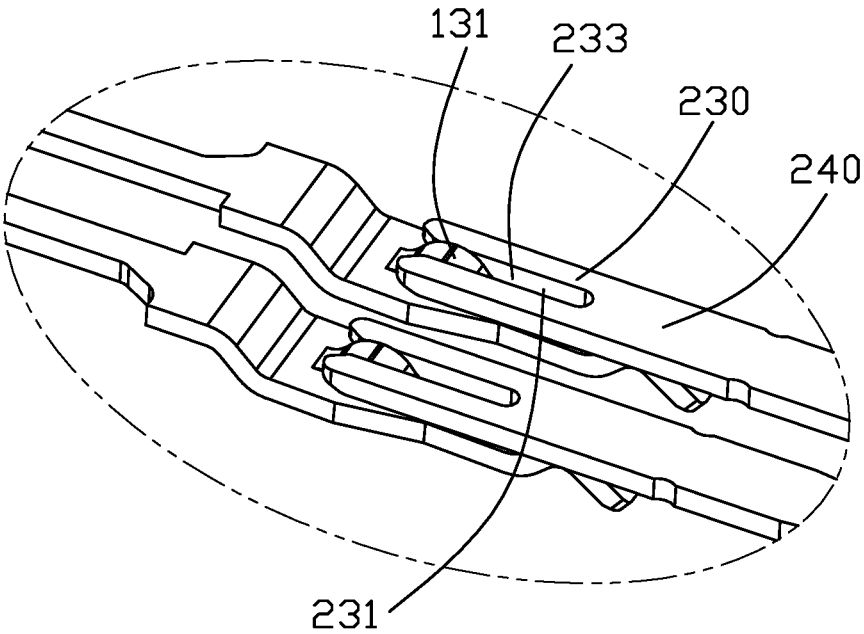
FIG. 5 is an enlarged view of the mating assembly in FIG. 2.
Figure 6:
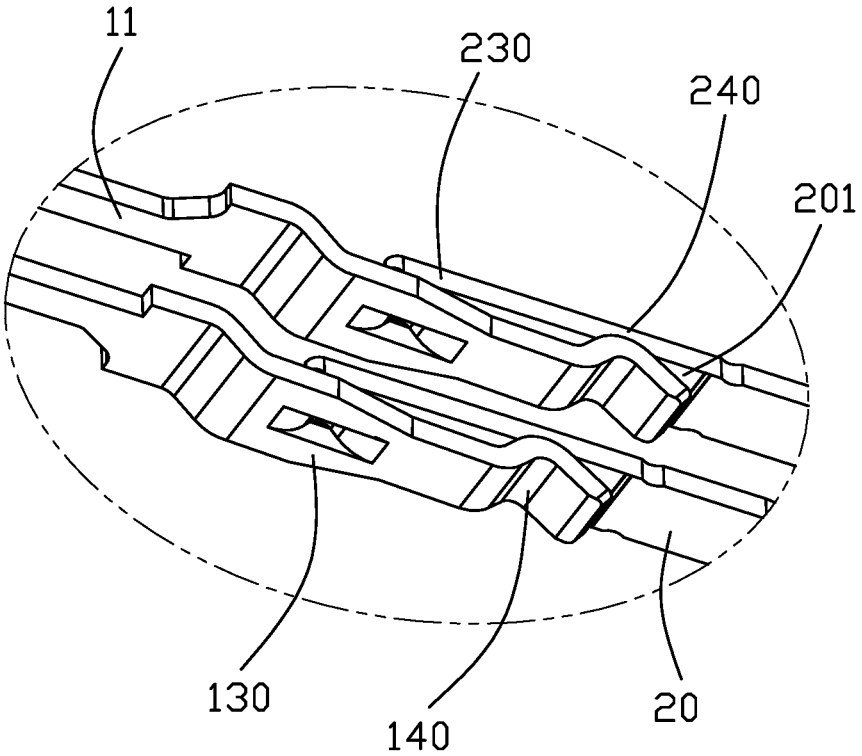
FIG. 6 is an enlarged view of the mating assembly in FIG. 3.

Referring to FIGS. 1-6, a mating assembly 100 of the first embodiment of the present invention comprises a conductive terminal 10 and a mating terminal 20 mated with the conductive terminal 10. The conductive terminal 10 is an elastic terminal, and the mating terminal 20 is substantially a flat structure.

The conductive terminal 10 includes a base 11 and a mating end 13 located at the front of the base 11 and mated with the mating terminal 20. The mating end 13 includes a first mating portion 130 mated with the mating terminal 20 and a second mating portion 140 arranged in front of the first mating portion 130 and mated with the mating terminal 20. The first matching portion 130 includes a first protrusion 131, and the second mating portion 140 includes a second protrusion 141. The first protrusion 131 and the second protrusion 141 protrude toward the same side of the conductive terminal 10. The first protrusion 131 is a structure formed by stamping, and the first protrusion 131 includes a pair of stamping surfaces 133 formed by stamping. The second protrusion 141 is a structure formed by bending.

The mating terminal 20 includes a flat mating contact portion 21. The mating contact portion 21 includes a first surface 201 facing the conductive terminal. The mating contact portion 21 includes a first mating contact portion 230 and a second mating contact portion 240 connected to the first mating contact portion 230. The first mating contact portion 230 includes a slot 231 extending along the front-to-rear direction and between two arms (not labeled) in the transverse direction perpendicular to the front-to-rear direction. The slot 231 includes two opposite side walls 233. The slot 231 extends forward through the front end of the mating terminal 20 so as to receive the first protrusion 131 in the slot 231 from the front end.

After the conductive terminal 10 is mated with the mating terminal 20 the second protrusion 141 is in contact with the second mating contact portion 240 and the first protrusion 131 is in contact with the first mating contact portion 230. The first protrusion 131 and the second protrusion 141 are engaged with the mating contact portion 21 of the mating terminal 20 in different ways. Specifically, in this embodiment, the first protrusion 131 is inelastically contacted with the mating terminal 20, and the second protrusion 141 is elastically abutted and contacted with the first surface 201 of the mating terminal 20. In addition, the mating direction of the first protrusion 131 and the mating terminal 20 is different from the mating direction of the second protrusion 141 and the mating terminal 20. In this embodiment, the second protrusion 141 is in contact with the first surface 201 of the mating terminal 20 along the first direction, the first direction is the direction in which the first protrusion 131 and the second protrusion 141 protrude. The first protrusion 131 is in contact with the mating terminal 20 in a second direction perpendicular to the first direction and perpendicular to the front-to-rear direction. In this embodiment, the size of the first protrusion 131 in the second direction is greater than the size of the slot 231 in the second direction. The two side walls 233 of the slot 231 can clamp the stamping surface 133, to form an effective contact.

In the present invention, the conductive terminals 10 and the mating terminals 20 are mostly designed in pairs, and are designed for differential signal transmission. The design of this structure can be used for backplane connectors and other related connector products with high-speed signal transmission specifications. Of course, it can also be used for other non-differential pair terminal interconnections.

Figure 7:
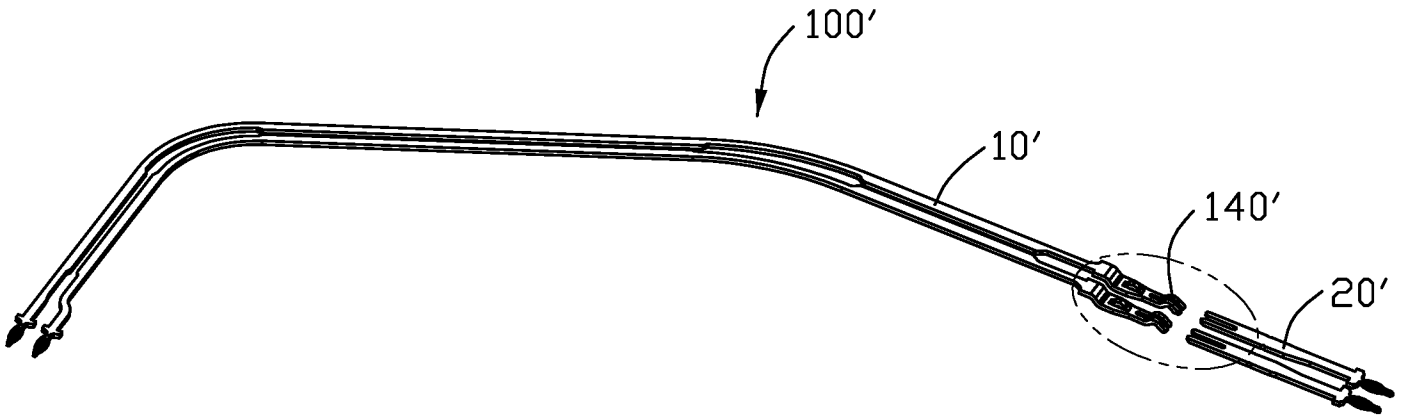
FIG. 7 is a perspective view of the second embodiment of a mating assembly of in accordance with the present invention in an unmated state.
Figure 8:
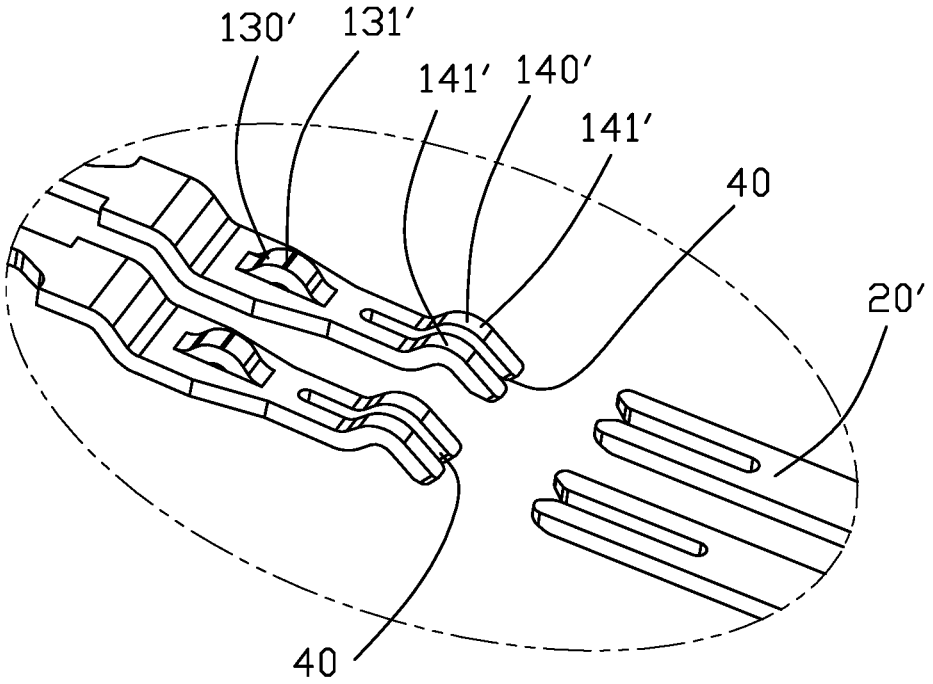
FIG. 8 is an enlarged view of the mating assembly in FIG. 7.

Referring to FIGS. 7-8, a mating assembly 100' of the second embodiment of the present invention is shown. In this embodiment, the second mating portion 140' of the conductive terminal 10' includes a slot 40 extending in the front-to-rear direction, the slot 40 divides the second mating portion 140' into a pair of elastic mating arms. The slot 40 reduces the flexural strength of the second mating portion 140' and facilitates the contact and mating of the first mating portion 130' with the mating terminal 20.

The mating assembly of the present invention adds a contact point on the basis of the traditional structural design, which effectively solves the impact of the capacitive effect of single-point contact on impedance matching during high-speed signal transmission, improves the impedance matching after mating, and improves the insertion loss. The mating direction and the mating manner of the first protrusion and the mating terminal of the mating assembly of the present invention are different from the mating direction and mating manner of the second protrusion and the mating terminal, to ensure that the first mating portion and the second mating portion can reliably contact and mate with the mating terminal. Therefore, the conductive terminal and the mating terminal can achieve a reliable mate of multiple contact points.

The above is only some of the embodiments of the present invention, but not all or the only embodiments. Any equivalent changes to the technical solutions of the present invention by those skilled in the art by reading the description of the present invention are covered by the claims of the present invention.

What is claimed is:

1. A conductive terminal to be mated with a mating terminal, the conductive terminal comprising:

a base; and a mating end at a front of the base for mating with the mating terminal, the mating end including:

a first mating portion for contacting with the mating terminal; and a second mating portion arranged in front of the first mating portion for contacting with the mating terminal, wherein the first mating portion includes a first protrusion, the second mating portion includes a second protrusion, the first protrusion and the second protrusion protrude toward same side of the conductive terminal, and the contacting direction and manner between the first protrusion and the mating terminal are different from the contacting direction and manner between the second protrusion and the mating terminal;

the second protrusion is in contact with the mating terminal in a first direction, and the first protrusion is in contact with the mating terminal in a second direction perpendicular to the first direction and perpendicular to a front-to-rear direction; and the second mating portion includes a slot extending in the front-to-rear direction, and the slot divides the second mating portion into a pair of elastic mating arms.

2. A conductive terminal to be mated with a mating terminal, the conductive terminal comprising:

a base; and a mating end at a front of the base for mating with the mating terminal, the mating end including:

a first mating portion for contacting with the mating terminal; and a second mating portion arranged in front of the first mating portion for contacting with the mating terminal, wherein the first mating portion includes a first protrusion, the second mating portion includes a second protrusion, the first protrusion and the second protrusion protrude toward same side of the conductive terminal, and the contacting direction and manner between the first protrusion and the mating terminal are different from the contacting direction and manner between the second protrusion and the mating terminal;

the first protrusion is formed by stamping, and the second protrusion is formed by bending; and the first protrusion includes a pair of stamping surfaces formed by stamping, the stamping surfaces are to be clamped by the mating terminal, and the second protrusion is to be elastically abutted by the mating terminal.

3. The conductive terminal as claimed in claim 2, wherein the second protrusion is in contact with the mating terminal in a first direction, and the first protrusion is in contact with the mating terminal in a second direction perpendicular to the first direction and perpendicular to a front-to-rear direction.

4. The conductive terminal as claimed in claim 2, wherein the second mating portion includes a pair of elastic mating arms and a slot extending in a front-to-rear direction between the pair of elastic mating arms.

5. A mating assembly comprising:

a mating terminal; and a conductive terminal mated with a mating terminal, the conductive terminal comprising:

a base; and a mating end at a front of the base for mating with the mating terminal, the mating end including:

a first mating portion contacted with the mating terminal; and a second mating portion arranged in front of the first mating portion and contacted with the mating terminal, wherein the first mating portion includes a first protrusion, the second mating portion includes a second protrusion, the first protrusion and the second protrusion protrude toward same side of the conductive terminal, and the contacting direction and manner between the first protrusion and the mating terminal are different from the contacting direction and manner between the second protrusion and the mating terminal;

the first protrusion is formed by stamping, and the second protrusion is formed by bending; and the mating terminal includes a flat mating contact portion, and the mating contact portion includes a first surface facing the conductive terminal, the mating contact portion includes a first mating contact portion and a second mating contact portion connected to the first mating contact portion, the first mating contact portion includes a slot along a front-to-rear direction, the slot includes two opposite side walls, the first protrusion includes a pair of stamping surfaces formed by stamping, the stamping surfaces are clamped and contacted with the side walls, and the second protrusion is elastically abutted and contacted with the first surface.

6. A mating assembly comprising:

a conductive terminal defining a first contacting part with a first bulged portion at a rear region thereof and a second bulged portion at a front region thereof wherein the first bulged portion and the second bulged portion are raised in a same vertical direction and offset from each other in both a front-to-back direction and a transverse direction both of which are not only perpendicular to each other but also perpendicular to the vertical direction; and a mating terminal defining a second contacting part with two arms spaced from each other with an elongated slot therebetween in the transverse direction; wherein during mating, the second contacting part abuts against the second bulged portion in the vertical direction and the two arms commonly sandwich the first bulged portion therebetween in the transverse direction.

7. The mating assembly as claimed in claim 6, wherein the second bulged portion forms therein a slot extending in the front-to-back direction along a centerline.

8. The mating assembly as claimed in claim 7, wherein the second contacting part is flat.

* * * * *